US007269933B2

(12) United States Patent
Le

(10) Patent No.: US 7,269,933 B2
(45) Date of Patent: Sep. 18, 2007

(54) RANDOM MULTI-STAGE AUTOMATIC CASE SEALER

(76) Inventor: Tuan Vinh Le, 3695 Kaneff Crescent, Suite 2006, Mississauga, Ontario (CA) L5A 4B6

( * ) Notice: Subject to any disclaimer, the term of this patent is extended or adjusted under 35 U.S.C. 154(b) by 0 days.

(21) Appl. No.: 10/846,252

(22) Filed: May 14, 2004

(65) Prior Publication Data

US 2004/0226268 A1 Nov. 18, 2004

(51) Int. Cl.
*B65B 7/20* (2006.01)

(52) U.S. Cl. ..... 53/491; 53/64; 53/67; 53/75; 53/76; 53/377.2; 53/376.7; 53/378.3

(58) Field of Classification Search ..... 53/52, 53/505, 64, 67, 75, 76, 377.2, 376.3, 376.4, 53/376.7, 378.3, 491, 504
See application file for complete search history.

(56) References Cited

U.S. PATENT DOCUMENTS

| | | | | |
|---|---|---|---|---|
| 1,887,699 | A | 11/1932 | Reid | |
| 3,282,018 | A | 11/1966 | Bixley | |
| 3,466,843 | A | 9/1969 | Mumper | |
| 3,775,937 | A | 12/1973 | Devan et al. | |
| 3,894,380 | A * | 7/1975 | Poulsen | 53/75 |
| 4,161,138 | A | 7/1979 | Marchetti | |
| 4,218,862 | A | 8/1980 | Marchetti | |
| 4,262,468 | A | 4/1981 | Marchetti | |
| 4,293,086 | A | 10/1981 | Fincher et al. | |
| 4,317,319 | A * | 3/1982 | Price | 53/76 |
| 4,554,042 | A | 11/1985 | Marchetti | |
| 4,585,504 | A | 4/1986 | Marchetti | |
| 4,722,165 | A * | 2/1988 | Marchetti | 53/76 |
| 5,099,979 | A | 3/1992 | Kehrel | |
| 5,323,586 | A | 6/1994 | Lissoni et al. | |
| 5,685,814 | A | 11/1997 | Le | |
| 5,916,106 | A | 6/1999 | Chen | |
| 6,067,773 | A | 5/2000 | Le | |
| 6,318,048 | B1 | 11/2001 | Sambuca, Jr. | |
| 6,319,183 | B1 * | 11/2001 | Ballos, III | 493/37 |
| 6,604,337 | B2 * | 8/2003 | Close et al. | 53/75 |
| 6,910,314 | B2 * | 6/2005 | Le | 53/136.4 |

FOREIGN PATENT DOCUMENTS

| | | |
|---|---|---|
| EP | 0 667 287 | 8/1995 |
| FR | 1438303 | 4/1966 |
| GB | 949343 | 2/1964 |
| GB | 1048674 | 11/1966 |

* cited by examiner

*Primary Examiner*—Christopher Harmon
(74) *Attorney, Agent, or Firm*—Butzel Long

(57) ABSTRACT

A case sealer has a frame with a low friction conveyor upon which boxes are moved in series through three stages, each having an independent pair of spaced-apart, lateral conveyors that are linked together for inward and outward movement to accommodate the width of the box to be sealed. A first measuring stage measures the height, width and length of the box. A second flap folding stage has a floating head located over its lateral conveyors and is responsive to the height and width of the box and folds the box end and side flaps into a closed position. When a box enters the flap folding stage, the lateral conveyors in the measuring stage open to accept the next box, and based on the speed of the lateral conveyors and the measured length of the previous box, a gate allows the next box to enter the measuring stage as soon as the previous box has cleared the measuring stage.

4 Claims, 6 Drawing Sheets

RANDOM MULTI-STAGE AUTOMATIC CASE SEALER

FIELD OF THE INVENTION

This invention relates to box or case sealers for closing the open ends of cardboard boxes or cartons.

BACKGROUND OF THE INVENTION

In the packaging industry, many products are packed in cardboard boxes or cartons for shipping. Often, one end of the box, namely the bottom, is sealed shut before the box is filled, and after the box is filled, the open top end of the box usually has end and side flaps that are folded inwardly and downwardly. The box can be sealed by applying glue to the inside of the mating surfaces of the folded flaps prior to them being folded shut, or by applying tape to the outside of the flaps after they have been folded shut.

In many cases, the boxes are uniform in size, so providing apparatus that will fold the flaps and apply adhesive or tape thereto is not particularly difficult to do. The apparatus can be adjusted to suit the known width and the height of the boxes and there is usually no problem running the boxes through the case sealer once it has been adjusted properly.

However, sometimes the boxes are of different sizes coming down the same conveyor line. In these instances, a random case sealer is required, wherein the apparatus for folding the box flaps and applying adhesive or tape thereto adjusts automatically to suit the size of the box.

In prior art random case sealers, various sensors have been used to try to determine the exact size or position of the boxes entering the case sealer, and numerous actuators or other adjustment mechanisms, together with suitable control devices, have been used to adjust the position of the various folding and sealing components to suit the position and size of the box being sealed. A difficulty with the prior art devices, however, is that the boxes are often misshaped or underfilled or overfilled, so that they are not uniform in shape, so the sensors often cannot determine the optimum position adjustments. The result is that the boxes get jammed in the apparatus shutting down the packaging line.

Another difficulty with some prior art case sealers is that they tend to be slow, in that if the boxes are of different sizes, a new box cannot enter or proceed through the case sealer until the previous box has cleared the sealer and the controls have been reset to be ready to receive the new box. An example of this is shown in U.S. Pat. No. 3,894,380 issued to Poulsen.

SUMMARY OF THE INVENTION

In the present invention, the boxes progress in a non-stop manner through measuring, flap folding and flap sealing stages, so that higher speeds are achieved because a new box can enter the sealer and start to be processed while one or more boxes are still having operations performed on them in the sealer.

According to use aspect of the invention, there is provided a case sealer comprising a frame including a low friction conveyor having an entrance portion and a longitudinal axis along which boxes entering the case sealer are moved. A measuring stage is located adjacent to the entrance portion and has a pair of longitudinal, spaced-apart, first lateral conveyors for moving boxes through the case sealer. A height sensor is located in the measuring stage for measuring the height of boxes passing through the measuring stage. A gate is provided for controlling entry of boxes into the measuring stage. A flap folding stage has a pair of longitudinal, spaced-apart, second lateral conveyors for receiving boxes from the first lateral conveyors and continuing the movement of the boxes through the case sealer. An entry sensor is provided for sensing a box entering the flap folding stage. Control means are connected to the entry sensor and operatively coupled to the gate, the control means being responsive to the flap folding stage entry sensor and lateral conveyor speed to open the gate to allow a new box to enter the measuring stage when a previous box has cleared the measuring stage and entered the flap folding stage. A floating head is spaced above the second lateral conveyors. The floating head includes an entrance ramp adapted to engage and fold inwardly a forward end flap on a box, and means coupled to the height sensor for lifting the floating head upwardly to a height to allow the entry ramp to fold the box forward flap inwardly. The floating head also includes a pivoting arm assembly pivotable downwardly after the box passes thereunder to fold inwardly a rearward end flap on the box. The floating head further includes diverging side bars for engaging and folding inwardly side flaps on the box after the rearward end flap has been folded inwardly. A seal dispensing platform is located adjacent to the flap folding stage and includes means coupled to the height sensor for locating the platform just above the height of the boxes passing thereunder from the flap folding stage. The seal dispensing platform further includes holding means for holding box flaps shut and being Adapted to mount a seal dispenser thereon for sealing the box flaps shut.

According to another aspect of the invention, there is provided a method of closing and sealing the flaps of successive boxes of different sizes in a case sealer having successively, a measuring stage, a flap folding stage and a sealing stage. The method comprises the steps of moving a first box into the measuring stage and measuring the height of the first box while moving the box through the measuring stage. A flap folding apparatus is provided in the flap folding stage. The flap folding apparatus is moved to a height corresponding to the measured height of the first box. The first box is continuously moved from the measuring stage through the flap folding stage. The box flaps of the first box are folded closed in the flap folding stage. When the first box clears the measuring stage is sensed. A second box is moved into the measuring stage as soon as the first box clears the measuring stage. The boxes from the flap folding stage are continuously moved to the sealing stage and the flaps are sealed closed in the sealing stage.

BRIEF DESCRIPTION OF THE DRAWINGS

Preferred embodiments of the invention will now be described, by way of example, with reference to the accompanying drawings, in which.

DETAILED DESCRIPTION OF THE PREFERRED EMBODIMENTS

Figure 2:
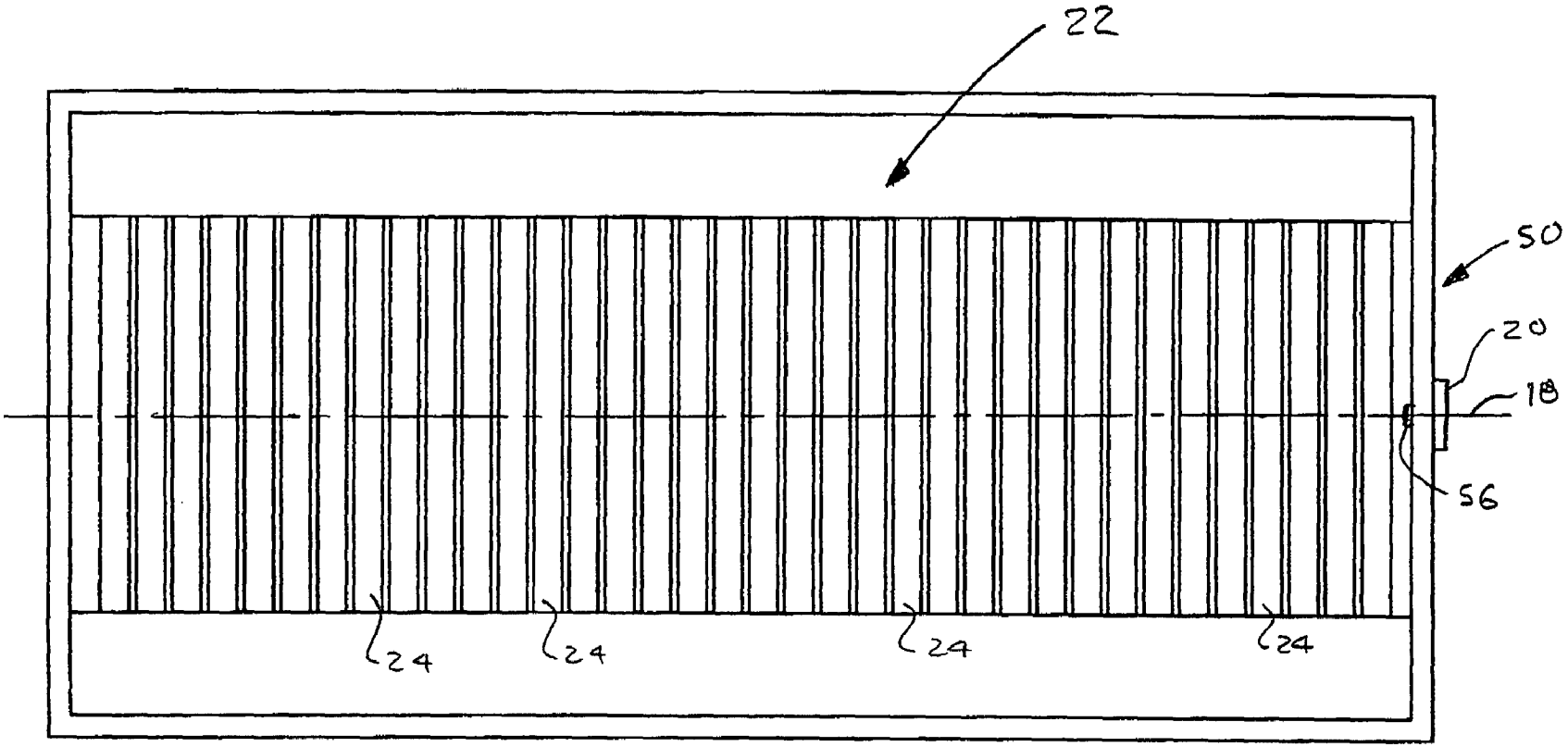
FIG. 2 is a plan view of the low friction conveyor used in the case sealer of FIG. 1.

Referring to the drawings, a preferred embodiment of a case sealer according to the present invention is generally indicated in the drawings by reference numeral 10. Case sealer 10 includes a frame 12 mounted on casters 14, so that the case sealer is easily transportable or movable from one packaging line to another. Retractable feet (not shown) may be threadably mounted in frame 12 to engage the floor and make case sealer stationary, if desired. Alternatively, casters 14 can be of the locking type, for the same purpose. Frame 12 has a longitudinal axis 18 (see FIG. 2) which indicates the direction in which boxes or cartons or cases travel to be closed and sealed shut in case sealer 10.

Case sealer 10 is normally located adjacent to a packaging line (not shown) to close and seal, one at a time, filled boxes received from such a packaging line. However, boxes or cartons could be manually placed on case sealer 10 if desired. Where the cases are received from a packaging line, a gate mechanism 20 can be provided to space the cases apart prior to being closed and sealed, as will be described further below. However, the gate mechanism could be provided on the end of the packaging line rather than on case sealer 10, if desired.

Case sealer 10 includes a low friction conveyor 22 which has a plurality of spaced-apart, transverse, free-wheeling rollers 24, although any other type of low friction conveyor could be used in case sealer 10. Rollers 24 support the boxes thereon to be sealed in case sealer 10.

Boxes that are ready to enter case sealer 10 are normally held back by the gate mechanism 20. When it is desired that the first box on a packaging line enter case sealer 10, gate mechanism 20 is lowered and the packaging line conveyor feeds a box to case sealer 10 causing the first box to be moved on to an entrance portion 50 of conveyor 22. When the box to be sealed enters entrance portion 50, an entry sensor or a limit switch 56 opens to sense that the front end of the box has passed that point, and a pair of longitudinal, laterally spaced-apart, first lateral conveyors 58 and 60, move inwardly to contact the box entering case sealer 10 and move it along axis 18. Limit switch 56 is an entry sensor means, and it could be any type of proximity sensor other than a limit switch per se. Lateral conveyors 58, 60 move at a constant speed, so when the trailing end of the box passes sensor 56, this limit switch closes, and this signal can be used to measure the length of the box entering case sealer 10. Alternatively, a proximity sensor could be used on one of the drive sprockets for lateral conveyors 58, 60 to measure the length of the boxes, as will be described further below.

Figure 3:
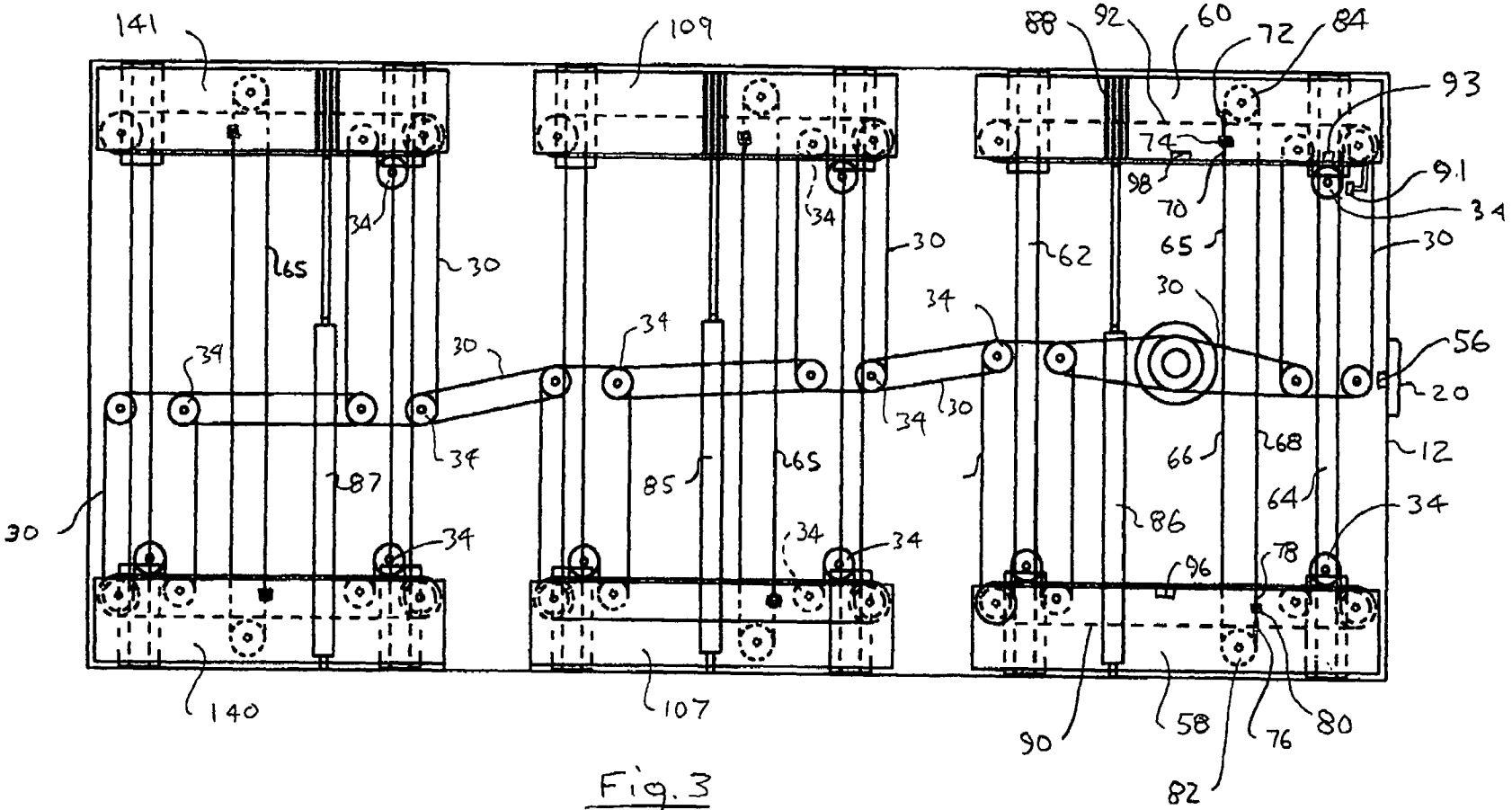
FIG. 3 is a plan view of the lateral conveyors and means for linking them together in the case sealer of FIGS. 1 and 2.
Figure 4:
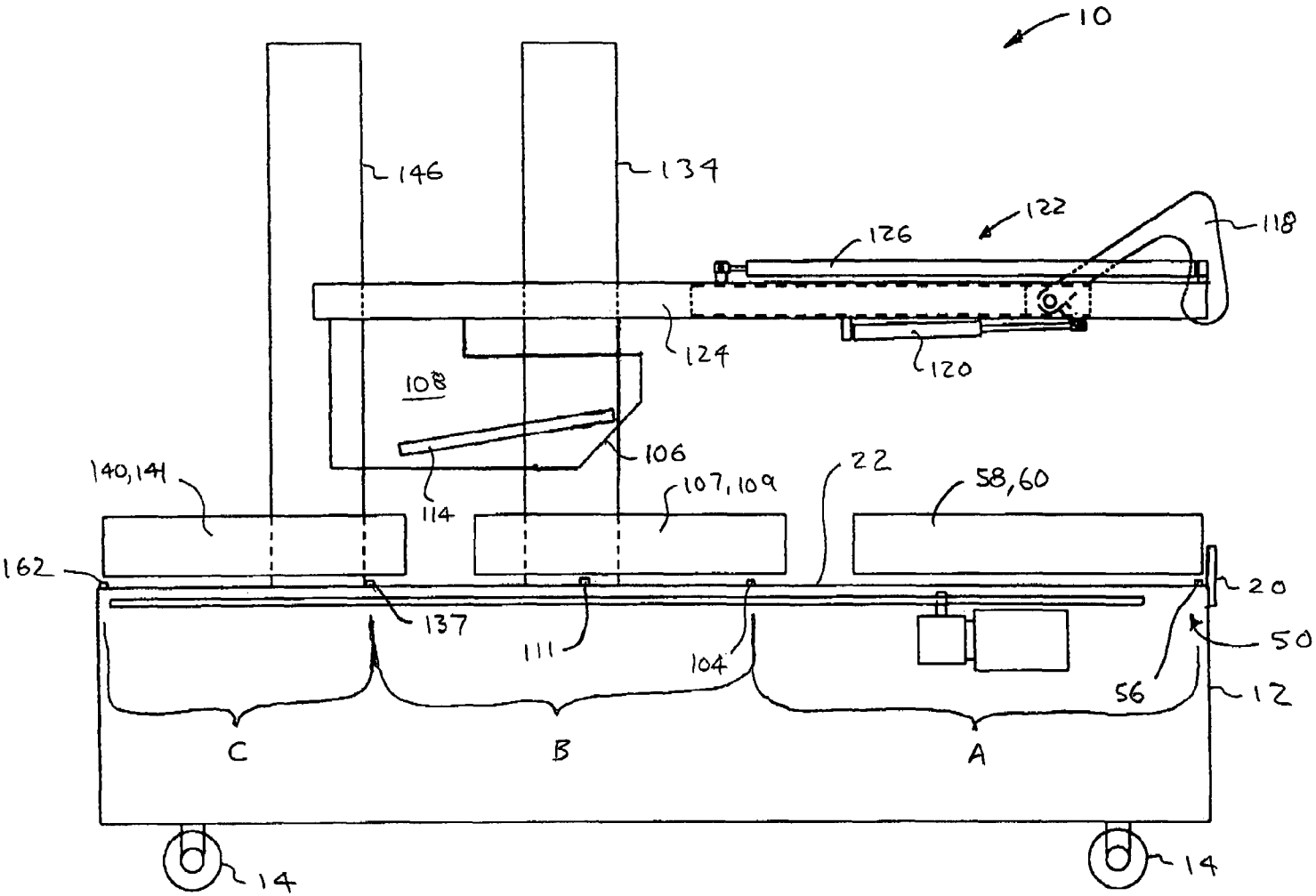
FIG. 4 is an elevational view similar to FIG. 1, but with components removed for the purposes of clarity, illustrating the operation of the pivoting arm assembly.

Referring next to FIGS. 3 and 4, first lateral conveyors 58 and 60 are slidably mounted on transverse shafts 62 and 64 for inward and outward movement to adjust for the width of a box being sealed in case sealer 10. Lateral conveyors 58 and 60 are linked together for equal movement inwardly and outwardly to match the width of the box passing therethrough. The linking means includes a continuous belt 65 having a pair of belt portions 66 and 68 (see FIG. 3). Each belt portion has one respective end 70, 72 attached to the frame of lateral conveyor 60 at a fixed mount 74, and a second opposed respective end 76, 78 attached to the frame of lateral conveyor 58 at a fixed mount 80. Sheaves 82 and 84 are rotatably mounted in frame 12, so that the belt portion 66 passes around sheave 82 and belt portion 68 passes around sheave 84, and as a result, when lateral conveyor 60 moves outwardly away from the longitudinal center line 18 of case sealer 10, belt portion 66 acting through and pulling on fixed mount 80 also causes lateral conveyor 58 to move outwardly away from the longitudinal center line of case sealer 10. Similarly, when lateral conveyor 60 moves inwardly towards the center line 18 of case sealer 10, belt portion 68 acting through and pulling on fixed mount 80 also causes lateral conveyor 58 to move inwardly towards the center line of the case sealer. Lateral conveyor 60 is moved inwardly and outwardly by a pneumatic cylinder 86 mounted in frame 12 and acting through a spring mount 88 attached to the frame of lateral conveyor 60. Spring mount 88 is simply a spring or other resilient member connected between the piston of pneumatic cylinder 86 and the frame of lateral conveyor 60. Spring mount 88 provides some flexibility for the relative positioning of lateral conveyors 58 and 60 to accommodate some non-uniformity in the width of the boxes being sealed in case sealer 10. The belt portions 66 and 68 pass around sheaves 82 and 84 in a U-shaped fashion. Chains and sprockets could be used in place of belts and sheaves. Other devices, such as racks and a pinion could also be used to link the lateral conveyors together, so that outward and inward movement of one lateral conveyor causes respective equal outward and inward movement of the other lateral conveyor. Again, some types of resilient connection, such as spring mount 88 would be used to prevent crushing of the boxes, yet providing sufficient frictional force by the lateral conveyors 58, 62 against the boxes to move the boxes through case sealer 10.

The normal starting position of lateral conveyors 58, 60 is in the outermost position, as seen in FIG. 3. When an incoming box hits entry sensor 56, cylinder 86 causes lateral conveyors 58, 60 to move inwardly to contact the box. Lateral conveyors 58 and 60 have respective conveyor belts 90 and 92 to move a box therebetween. If a box travelling between lateral conveyors 58 and 60 is off center, it will hit one of the lateral conveyor belts 90 or 92 first, and this conveyor belt will move the box over toward the center until it contacts the other of the lateral conveyor belts, and thus be centered.

Lateral conveyors 58 and 60 also have centering sensors 96 and 98 mounted just above their respective conveyor belts 90 and 92. Centering sensors 96 and 98 are pivotably mounted bars that actuate limit switches behind them. When a box hits one of the centering sensors 96 or 98, the sensor retracts opening its limit switch, but nothing happens until the box is moved over toward the center of the case sealer, and then it hits the other centering sensor. When both the centering sensors 96 and 98 are engaged by the box, the box is centered. The respective limit switches in sensors 96 and 98 are connected in parallel and when both switches are opened, this causes the lateral conveyors 58, 60 to stop moving inwardly. This also causes a signal to be recorded by a programmable logic controller (not shown) that controls the operation of case sealer 10.

Lateral conveyors 58, 60 then move the box along in case sealer 10. The speed of lateral conveyors 58, 60 is faster than the speed of the packaging line conveyor that feeds the boxes into case sealer 10, so a gap opens up between a box that has already entered lateral conveyors 58, 60 and the next following box. When the lower back lateral edge of the box passes entry sensor 56, gate 20 is raised to hold back the next box until the box presently between lateral conveyors 58, 60 clears those lateral conveyors and they open up again, as described further below.

As mentioned above, the length of the boxes entering lateral conveyors 58, 60 can be measured using signals from entry sensor 56, but the box length could also be measured using a proximity sensor 91 (see FIG. 3). Sensor 91 is of the inductive type that counts the teeth on one of the sprockets 34 that drives lateral conveyors 58,60. When a front vertical corner of the box hits a limit switch or sensor 93, which is similar to the centering sensors 96 and 98, proximity sensor 91 starts counting sprocket teeth, and when the rear vertical corner of the box passes sensor 93, proximity sensor 91 stops counting teeth. The number of teeth information is sent to the logic controller controlling case sealer 10 and the controller calculates and stores the length of the box information.

Figure 5:
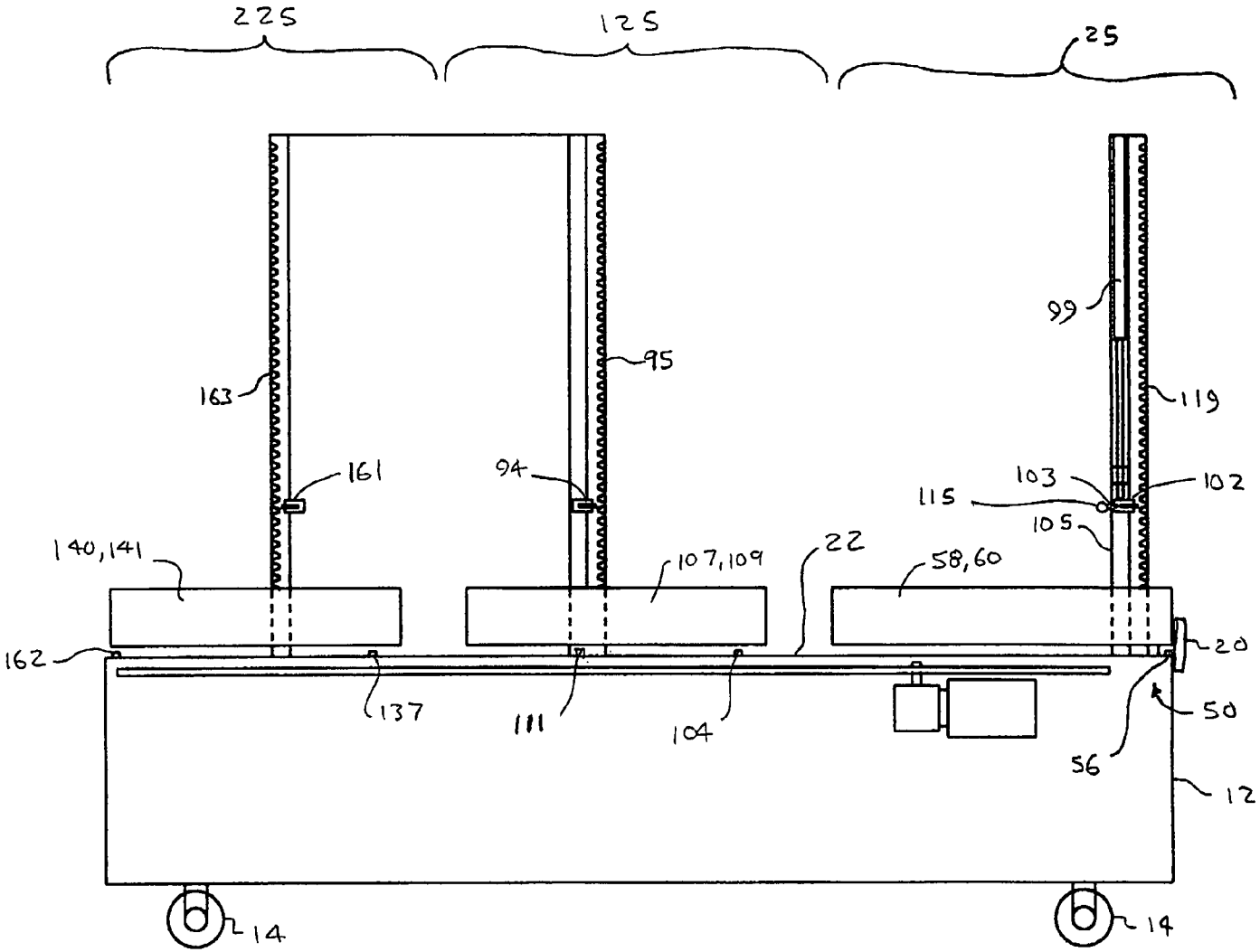
FIG. 5 is an elevational view similar to FIG. 4, but with still further components removed for the purposes of clarity, and showing another embodiment of the height measuring proximity sensors.
Figure 6:
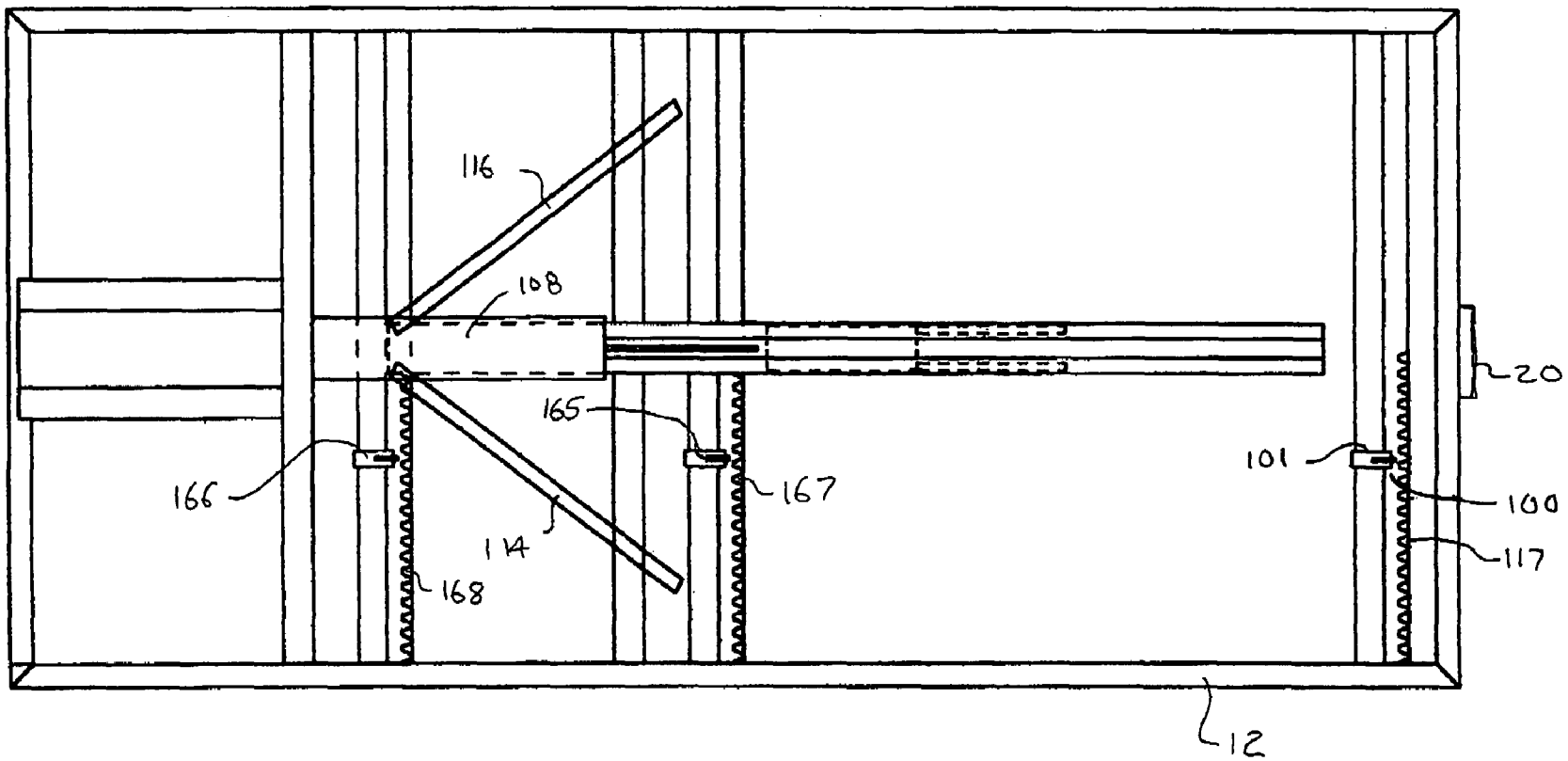
FIG. 6 is a plan view of the case sealer of FIG. 1 with components removed for the purposes of clarity, and showing another embodiment of the width sensors.

Referring next to FIGS. 5 and 6, when a box enters case sealer 10 and hits or activates entry sensor 56, a horizontal proximity sensor 100 and a vertical proximity sensor 102 are activated. These proximity sensors are also of the inductive type that count teeth, but on stationary strips 117 and 119 mounted on frame 12. Proximity sensor 100 has a pick-up head 101 mounted on lateral conveyor 58, and sensor 102 has a pick-up head 103 slidably mounted on an upright post 105.

Head 101 moves with the conveyor 58 so that the proximity sensor 100 can count the teeth on the strip 117. The sensor 100 starts to count the teeth on the strip 117 to determine the width of the box when the entry sensor 56 senses the box entering the sealer 10 This sensor 100 will stop counting teeth when conveyors 58 and 60 engage a box and are stopped. In other words, when the sensors 96 and 98 contact the box, the sensor 100 stops counting and the number of teeth signal is received by the case sealer logic controller.

Head 103 is moved vertically by a cylinder 99 activated by the case sealer logic controller when the entry sensor 56 senses a box entering case sealer 10. Head 103 also includes a photo eye 115 which senses the top edge of the box side flaps and stops the sensor 102 from counting teeth on toothed strip 119. Proximity sensors 100 and 102 send signals to the logic controller controlling case sealer 10 based on the number of teeth counted, and these signals are used to measure or calculate the width and height of the box entering lateral conveyors 58, 60. The height includes the upright box side flaps, and since the width of these flaps is one-half the width of the box, the height of the box with flaps closed can easily be calculated based on this ratio. The area of case sealer 10 including lateral conveyors 58, 60 and proximity sensors 100 and 102 is called the measuring stage 25 (see also FIG. 1) of case sealer 10, because its primary function is to measure the height and width of the boxes as they enter case sealer 10. Entry sensor 56 and cylinder 86, together with linking belts 65, centering sensors 96, 98 and proximity sensor 100, constitute width sensing and actuation means in the preferred embodiment.

As the box continues to advance in case sealer 10, the box reaches another sensor point or limit switch 104 (see FIG. 1) causing the controller to close a pair of longitudinal, spaced-apart, second lateral conveyors 107 and 109 that contact the box, and after that, lateral conveyors 58, 60 are opened to be returned to the home position and be ready to receive the next box. The second lateral conveyors 107 and 109 are linked together and moved by a cylinder 85 (see FIG. 3) in the same way as conveyors 58 and 60, and they continue at the same speed as lateral conveyors 58 and 60 to move the box through case sealer 10 until the leading top flap of the box engages an upwardly inclined entry ramp 106 (see FIG. 1) mounted in a first floating head 108 spaced above the lateral conveyors 107 and 109.

Floating head 108 includes a transverse member (not shown) attached at its opposed distal ends to slides mounted for vertical sliding movement on shafts in towers 134, as shown more particularly in U.S. patent application Ser. No. 10/330,268 filed Dec. 30, 2002, and incorporated herein by reference. Cylinders 112 mounted in towers 134 are connected to the slides to move the floating head 108 up and down, as described further below. Towers 134 further include counterweight devices 136 attached to the slides to offset the weight of floating head 108. Counterweight devices 136 could be gravitational devices or coil spring type devices, as desired. The area of case sealer 10 including lateral conveyors 107, 109 and floating head 108 is called the flap folding stage 125 of case sealer 10, because its primary function is to fold down the flaps of the boxes.

Prior to the leading top flap of the box hitting entry ramp 106 of floating head 108, the logic controller controlling case sealer 10 actuates pneumatic cylinder 112 to raise or lower floating head 108 upwardly or downwardly to a desired height to fold down the leading end flap of the box. This height is calculated based on the height and width measurements provided by proximity sensors 102 and 100 in measuring stage 25. Actually it is about 5 percent higher, in case the box side flaps are not perfectly vertical.

In order to determine in which vertical direction to move floating head 108, the present position of floating head must be known. Referring to FIG. 5, this is determined by a proximity sensor 94 mounted on floating head 108. Sensor 94 counts teeth on another vertical toothed strip 95, and sends this information to the logic controller controlling case sealer 10. The logic controller can then determine if floating head 108 is high or low and move it to the desired height for the box located between lateral conveyors 107, 109.

As the box advances further between lateral conveyors 107,109 and the leading top flap of the box has started to be folded down, upwardly and outwardly disposed side bars 114 and 116 (see FIGS. 1, 4 and 6) engage the box side flaps and fold them inwardly. Before the box side flaps are folded down, however, the trailing end flap of the box is folded downwardly by a pivot arm 118 actuated by another pneumatic cylinder 120. Pivot arm 118 is activated when the box hits another sensor point or limit switch 111.

Pivot arm 118 and pneumatic cylinder 120 are part of a pivot arm assembly 122 slidably mounted in a telescopic boom 124 mounted in floating head 108. Pivot arm assembly 122 is moved along boom 124 by another pneumatic cylinder 126 to accommodate and close the trailing end flaps of boxes of varying lengths up to about 60 inches or even longer simply by making boom 124 and the lateral conveyors longer, as required.

Since the length of the box is preferably determined by proximity sensor 91 and limit switch or sensor 93 opening and closing, as soon as the trailing end of the box passes lateral conveyors 58,60 based on this length measurement, the logic controller controlling case sealer 10 can open gate 20 to allow the next box to move into measuring stage 25.

As the first box continues to advance in case sealer 10, the box reaches another sensor point or limit switch 137 (see FIG. 1) causing the controller to close a pair of longitudinal, spaced-apart, third lateral conveyors 140 and 141, and thereafter to open second lateral conveyors 107, 109. The third lateral conveyors 140 and 141 are linked together and moved by a cylinder 87 (see FIG. 3) in the same way as second lateral conveyors 107, 109, and they continue at the same speed as second lateral conveyors 107, 109 to move the box through case sealer 10.

As the box passes out through the lateral conveyors 107, 109 and while the box top flaps are still being held down by floating head 108, the top, leading horizontal edge of the box engages an entry ramp 138 (see FIG. 1) mounted in a second floating head 142. Floating head 142 is similar to floating head 108 in that it has a transverse member (not shown) having opposed ends attached to slides slidably mounted on shafts in towers 146 with pneumatic cylinders 148 to move the floating head up or down to match the height of the boxes entering lateral conveyors 140,141. Counterweight devices 150 offset the weight of the floating head 142. Floating head 142 has a seal dispensing platform 158 on which is mounted a tape head 160 through spring mounts 159 to provide some flexibility for the relative positioning of floating head 142 and to accommodate some non-uniformity in the height of the boxes (up to 5 centimetres) such as may be caused by overfilling, for example. Sensor point or limit switch 137 sends a signal to logic controller controlling case sealer 10 to activate cylinder 148 through an appropriate actuator valve device to raise and lower second floating head 142 to the desired height of the box as determined in measuring stage 25. This height is about 5 percent lower than the height at which first floating head 108 was set, so it is pretty well just above the height of the box with the flaps folded down.

In order to determine in which vertical direction to move second floating head 142, the present position of floating head 142 must be known. Referring again to FIG. 5, this is determined by a proximity sensor 161 mounted on floating head 142. Sensor 161 counts the teeth on another vertical toothed strip 163, and sends this information to the logic controller controlling case sealer 10. The logic controller can then determine if floating head 142 is high or low and move it to the desired height for the box located between lateral conveyors 140, 141.

If desired, floating head 142 can be raised a bit higher than the measured height of the box, and it can then be moved back down a bit until a proximity sensor or limit switch 113 engages the box. This determines the exact height of the box. In this way, floating head 142 rises to the desired height, even if the box is over filled.

If desired, the logic controller controlling case sealer 10, could be programmed to reset or return floating heads 108 and 142 to their highest or home positions after the boxes clear the respective flap folding and sealing stages, to ensure that the floating heads are precisely set at the desired height.

When the box passes under seal dispensing platform 158 and the rear corner of the box passes another sensor point or limit switch 162, the third lateral conveyors 140, 141 move outwardly. The area of case sealer 10 including lateral conveyors 140, 141 and floating head 142 is called the sealing stage 225, because its primary function is to seal the flaps of the boxes.

If desired, floating heads 108 and 142 could be combined into a single floating head by attaching second head 142 to first floating head 108. The advantage of using separate floating heads, however, is that as soon as a box is picked up by lateral conveyors 140, 141 and the box has cleared floating head 108, the lateral conveyors 107, 109 and first floating head 108 can be reset to receive the next box, thus proving faster operation for case sealer 10.

Figure 1:
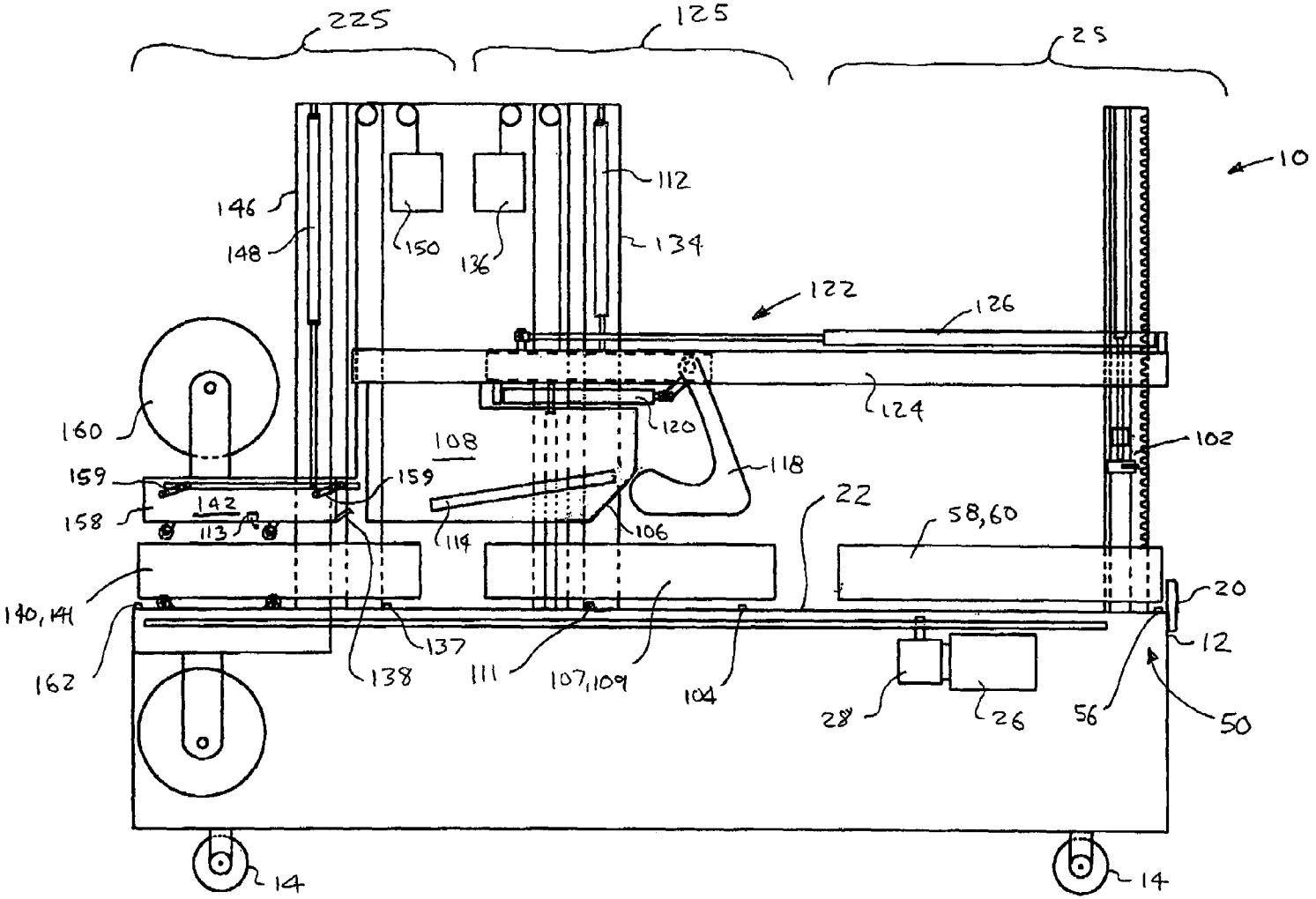
FIG. 1 is a side elevational view of a preferred embodiment of a case sealer according to the present invention.

As seen best in FIGS. 1 and 3, lateral conveyors 58, 60; 107, 109 and 140, 141 are driven by a motor 26 and gear box 28 driving a series of sprockets 34 and drive chains 30. All of the lateral conveyors preferably operate at the same speed.

Referring again to FIG. 4, the longitudinal distance between sensor 56 and sensor 104 is indicated as "A". The longitudinal distance between sensor 104 and sensor 137 is indicated as "B", and the longitudinal distance between sensor 137 and sensor 162 is indicated as "C". Distance "A" is greater than distance "B", which in turn is greater than distance "C". This ensures that any given box will move out of its respective one of the measuring stage 25, flap folding stage 125 or sealing stage 225, before the box next behind it enters that stage. Alternatively, lateral conveyors 140, 141 could be made to operate at a higher speed than lateral conveyors 107, 109 (say 20 percent faster), and lateral conveyors 107, 109 could operate at a faster speed than lateral conveyors 58, 60 to accomplish the same thing. If differential speeds are used to separate the boxes, however, the preceding set of lateral conveyors should open immediately after the succeeding set of lateral conveyors picks up the box, or there would be functional scraping of the sides of the box by the two sets of lateral conveyors in contact with the box.

In the operation of case sealer 10, the case sealer can be made to operate in several different modes as selected by a control box (not shown) containing the programmable logic controller for case sealer 10. Where the boxes are all of the same height, width and length, after the first box enters measuring stage 25, the height and width of all the boxes being sealed are known, so lateral conveyors 58, 60; 107, 109 and 140, 141 and the height of floating heads 108 and 142 can be set and not moved thereafter. Gate 60 is used to allow the boxes to be separated by a space of about 15 inches to allow the box rear flaps to be folded down by pivot arm 118. A box can go on to have its flaps folded down while a box behind it is entering the measuring stage 25. Similarly, a box can be sealed by the floating sealing head 142 while another box is entering lateral conveyors 107 and 109 to have its flaps folded down by floating head 108. Once a box enters case sealer 10, it moves continuously or non-stop until it exits the case sealer.

In a second mode of operation where the height and width of the boxes are the same but the lengths of the boxes vary and exceed a length of about 24 inches, the cylinder 126 moves the pivot arm assembly 122 out to the end of boom 124, and as soon as the rear end of the box is sensed passing limit switch 56, cylinder 126 retracts the pivot arm assembly 122, so that pivot arm 118 travels along at the same speed as the box. As the box hits sensor point 111, and just prior to the box side flaps being folded down on top of the box front flap by side bars 114, 116, pivot arm 118 comes down to close the back flap of the box. Again, in this mode of operation, since the height and width of the boxes are known after the first box enters the measuring stage 25, lateral conveyors 58, 60; 107, 109 and 140, 141 and the height of floating heads 108 and 142 can be set and not moved thereafter.

In a third mode of operation where the boxes vary in length, width and height between about 20 and 60 centimetres, the pivot arm assembly 122 stays in its inward or retracted position. The gate mechanism 20 is not lowered to let the next box enter the case sealer until the rear end of the previous box clears lateral conveyors 58, 60. Limit switch 111 is used to activate pivot arm 118.

In a fourth mode of operation, where the boxes vary in width and height, and also in length between about 60 centimetres and about 1.5 metres, the pivot arm assembly 122 extends to the outer end of boom 124 and retracts with the box as in the second mode above. However, when the front end wall of the box hits limit switch 111, and just prior to the box side flaps being folded down by side bars 114, pivot arm 118 comes down to close the back flap of the box.

In a fifth mode of operation, where most of the boxes are under 24 inches in length, and only occasionally are longer, the position of pivot arm 118 on boom 124 could be set based on the length of the boxes being less than 24 inches. If the box is over 24 inches in length, the pivot arm assembly 122 would extend pivot arm 118 to the outer end of boom 124 and retract, as in the second mode above.

It will be appreciated that as soon as a box is picked up by the next set of lateral conveyors 107, 109 or 140, 141, the respective previous set of lateral conveyors 58, 60 or 107, 109 can be returned to their home positions, or positioned to fit the width of the next box entering them, as measured in measuring stage 25. In other words, as soon as a box clears any of the sets of lateral conveyors, the next box can enter the cleared set of lateral conveyors in front of it. In this way, one box can be measured in measuring stage 25, while another box is having its flaps closed in flap folding stage 125, and yet another box can be having its flaps taped or glued shut in sealing stage 225. This results in very fast operation for case sealer 10. The operation is a little slower when one floating head is used for both the flap folding stage 125 and the sealing stage 225.

Having described preferred embodiments of the invention, it will be appreciated that various modifications may be made to the structures described above. For example, instead of using pneumatic cylinders to control the various components of the case sealers, it will be appreciated that hydraulic devices or electric motors or solenoids could be used as well. Programmable logic controllers are preferred for controlling the various components of the case sealers, but other types of controls could be used as well, such as simple timers. Limit switches have been described as the preferred position sensors, but other devices such as photoelectric, infrared or other motion sensors or proximity sensors could be used as well. Alternatively, the logic controller could provide the necessary inputs that are provided by limit switches 104, 111, 137 and 162. Instead of using toothed strips 117, 119 to measure the width and height of the boxes, chains and sprockets, with the pulses being picked up from the sprockets, can be used with sensors 100 and 102 to measure width and height, if desired. In other words, instead of using a cylinder 99 coupled directly to pick-up head 103, a continuous chain running around sprockets could be used with head 103 mounted to pick-up pulses from one of the sprockets, and photo eye 115 mounted on the chain.

If desired, when a box arrives at sensor 137 of the flap folding stage 125, the logic controller could activate cylinders 85 and/or 87 (see FIG. 3) to move the conveyors 107, 109 and/or 140, 141 inward to a desired width, as this is the same width measured in the measuring stage 25. For example, if the box width measured by the measuring stage 25 is 10 inches (or counted 40 teeth) the controller could calculate and then activate the cylinders 85 and 87 to move lateral conveyors 107, 109 and 140, 141 to suit the 10 inch width box. In order to do this, however, the logic controller must know the position of the lateral conveyors 107, 109 and 140, 141. This can be accomplished by using proximity sensors 165 and 166 (see FIG. 6) and toothed strips 167, 168, in much the same manner as in the case of proximity sensor 100 and toothed strip 117. Sprocket teeth pickups could also be used with proximity sensors 100, 165 and 166, as mentioned above.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

The invention claimed is:

1. A method of closing and scaling the flaps of successive boxes of different sizes in a case sealer having successively, a measuring stage, a flap folding stage and a sealing stage, wherein boxes of different dimensions move successively through the measuring stage, flap folding stage and scaling stage in a continuous manner, the method comprising the steps of:

moving a first box into the measuring stage and measuring the height of the first box while moving the first box through the measuring stage;

providing a flap folding apparatus in the flap folding stage moving the flap folding apparatus to a height corresponding to the measured height of the first box;

continuously moving the first box from the measuring stage through the flap folding stage while sensing when the first box clears the measuring stage and moving a second box of at least one of different height and width than the first box into the measuring stage as the first box clears the measuring stage;

folding the first box closed in the flap folding stage;

continuously moving the first box from the flap folding stage to the sealing stage while moving the second box from the measuring stage to the flap folding stage;

sealing the flaps of the first box closed in the seating stage;

continuously removing the first box from sealing stage while moving the second box from the flap folding stage to the sealing stage;

sealing the flaps of the second box closed in the sealing stage;

wherein each of the first and second boxes are moved through the measuring, flap folding and sealing stage by providing lateral conveyors in each stage and gripping the sides of each of the first and second boxes by said conveyors;

measuring the length of the first and second boxes in the measuring stage; and sensing when the first box has entered the flap folding stage, and opening the lateral conveyors in the measuring stage when the first box enter the flap folding stage.

2. A method as claimed in claim 1 further comprising the steps of determining the speed of the lateral conveyors in the flap folding stage, and using the measured length of the first box, allowing the second box to enter the measuring stage when the first box has cleared the measuring stage.

3. A method as claimed in claim 1 further comprising the steps of measuring the width of the first and second boxes in the measuring stage and adjusting the lateral conveyors in the flap folding stage to suit the measured width of each of the first and second boxes.

4. A method as claimed in claim 3, further comprising the steps of determining the speed of the lateral conveyors in the flap folding stage, and using the measured length of the first box, allowing the second box to enter the measuring stage when the first box has cleared the measuring stage.

* * * * *